US005435135A

United States Patent [19]

Lallier et al.

[11] Patent Number: 5,435,135

[45] Date of Patent: Jul. 25, 1995

[54] REVERSIBLE PRESSURIZED FLUID MECHANISM SUCH AS A MOTOR OR A PUMP AND HAVING AT LEAST TWO OPERATING CYLINDER CAPACITIES

[75] Inventors: Jean-Claude Lallier, Crepy en Valois; Gilles LeMaire, Margny-les-Compiegne, both of France

[73] Assignee: Poclain Hydraulics, France

[21] Appl. No.: 255,462

[22] Filed: Jun. 8, 1994

[30] Foreign Application Priority Data

Jun. 9, 1993 [FR] France ..... 93 06903

[51] Int. Cl.[6] ..... F16D 31/02

[52] U.S. Cl. ..... 60/425; 60/427; 60/483; 91/491

[58] Field of Search ..... 60/425, 427, 483, 494; 91/474, 491, 492

[56] References Cited

U.S. PATENT DOCUMENTS

| | | | |
|---|---|---|---|
| 3,403,599 | 10/1968 | Guinot | 91/205 |
| 3,849,985 | 11/1974 | Ratliff et al. | 60/483 |
| 4,404,896 | 9/1983 | Allart et al. | 91/491 |
| 4,898,076 | 2/1990 | Bigo et al. | 91/491 |

FOREIGN PATENT DOCUMENTS

| | | |
|---|---|---|
| 0284460 | 9/1988 | European Pat. Off. . |
| 2481755 | 11/1981 | France . |
| 1528519 | 7/1970 | Germany . |

*Primary Examiner*—F. Daniel Lopez
*Attorney, Agent, or Firm*—Ladas & Parry

[57] ABSTRACT

The invention concerns a dual-capacity hydraulic motor. In accordance with the invention, the capacity selector device comprises two valves each having a body with two grooves and a sliding slide valve with only one groove. One application is to the implementation of a low-cost, lightweight motor that is compact in the axial direction.

10 Claims, 7 Drawing Sheets

REVERSIBLE PRESSURIZED FLUID MECHANISM SUCH AS A MOTOR OR A PUMP AND HAVING AT LEAST TWO OPERATING CYLINDER CAPACITIES

BACKGROUND OF THE INVENTION

FR-A-2 481 755 describes and shows a pressurized fluid mechanism, such as a reversible hydraulic motor or pump having at least two operating cylinder capacities, and comprising: a stator; a rotor rotatable relative to the stator about a rotation axis; main fluid inlet and outlet chambers, one adapted to communicate selectively with a source of high-pressure fluid and the other adapted to communicate selectively with a low-pressure return; an undulating cam including a plurality of undulations divided into two groups of first undulations and second undulations, respectively; a plurality of cylinders inside each of which slides at least one piston defining a working chamber inside said cylinder; an internal distributor for distributing fluid to said working chambers including first secondary inlet and outlet chambers for distributing fluid to the working chambers in the cylinders facing the undulations of the first group of undulations and second secondary inlet and outlet chambers for distributing fluid to the working chambers in the cylinders facing the undulations of the second group of undulations; and a capacity selector device which in a "large capacity" first configuration connects in parallel firstly the first and second secondary inlet chambers and secondly the first and second secondary outlet chambers and in a "small capacity" second configuration isolates the second secondary inlet and outlet chambers from whichever of the main inlet and outlet chambers contains the fluid at the higher pressure and establishes communication of said second secondary inlet and outlet chambers with each other and with whichever of the main inlet and outlet chambers contains the fluid at the lower pressure.

The operation of a mechanism of this kind is satisfactory but its design requires the manufacture of specialized, and therefore relatively costly, components disposed at specific locations, with the result that its overall axial and radial dimensions are relatively large. One of the specialized components is a shuttle valve contained in a capacity selector slide valve of that prior art mechanism.

OBJECTS AND SUMMARY OF THE INVENTION

An object of the invention is to provide a pressurized fluid mechanism as defined above which is more compact than the known mechanisms and to this end uses, instead of the prior art capacity selector slide valve and its specialized shuttle valve, two valves that are shorter in the axial direction and less costly than the prior art device.

The invention therefore consists firstly in adopting the following features A) to E): A) the capacity selector device comprises a first valve and a second valve each of which has a valve body, a member mobile in said body between first and second positions, the moving members of the two valves being separate and independent of each other, a first groove in said body, a second groove in said body, an automatic control chamber and an intentional control chamber, said intentional control chamber being adapted to contain selectively a control fluid from a control fluid source and an unpressurized fluid; B) the following connections are made: the connection of the main inlet chamber to the first secondary inlet chamber; the connection of the main outlet chamber to the first secondary outlet chamber; the connection of the first secondary inlet chamber to the automatic control chamber of the first valve; the connection of the first secondary outlet chamber to the automatic control chamber of the second valve; the connection of the first groove of the first valve to the first secondary outlet chamber; the connection of the first groove of the second valve to the first secondary inlet chamber; the connection of the second groove of the first valve to the second secondary outlet chamber; and the connection of the second groove of the second valve to the second secondary inlet chamber; C) the first valve in its first position establishes communication between its second groove and its automatic control chamber and isolates its first groove from its second groove and from said automatic control chamber and in its second position establishes communication of its first and second grooves with each other and isolates its automatic control chamber from said first and second grooves; D) the second valve in its first position establishes communication between its second groove and its automatic control chamber and isolates its first groove from its second groove and from said automatic control chamber and in its second position establishes communication of its first and second grooves with each other and isolates its automatic control chamber from said first and second grooves; E) so that the following configurations can be selected: E1—communication of the intentional control chambers of the first and second valves with a reservoir of unpressurized fluid causing the moving members of the first and second valves to be moved to their respective second positions and selecting the "large capacity" configuration; E2—communication of the first secondary inlet chamber with a pressurized fluid source, of the first secondary outlet chamber with a low-pressure return and of the intentional control chambers of the first and second valves with a control fluid source causing the moving member of the first valve to be moved to its second position and the moving member of the second valve to be moved to its first position and thereby selecting the "small capacity" configuration corresponding to rotation of the rotor in a first direction of rotation; E3—communication of the first secondary inlet chamber with a low-pressure return, of the first secondary outlet chamber with a high-pressure fluid source and of the intentional control chambers of the first and second valves with a control fluid source causing the moving member of the first valve to be moved to its first position and the moving member of the second valve to be moved to its second position and thereby selecting the "small capacity" configuration corresponding to rotation of the rotor in the direction of rotation opposite to said first direction of rotation.

The following advantageous features are preferably adopted:

the moving member of each of the first and second valves comprises a slide valve having an axis constituting a slide axis of said slide valve, the slide axes of the slide valves of said two valves being separate and both parallel to the rotation axis, the body of the first valve extending between two transverse planes perpendicular to the rotation axis and the body of the second valve extending substantially between the same two transverse planes so that the overall longitudinal dimension of the set of two valves is substantially equal to that of each valve;

the mechanism includes a casing containing the internal fluid distributor and delimited by a wall in which are formed the bodies of said first and second valves;

the moving members of the first and second valves are identical;

each of the first and second valves has a return spring member urging its moving member towards its first position against the action of the pressure of the fluid contained in its automatic control chamber and during selective communication of its intentional control chamber with the control fluid when the automatic control chamber contains the low-pressure return fluid, the sum of the effects of the pressure of the control fluid and the return spring member on the moving member is greater than the effect of the pressure of the fluid contained in the automatic control chamber so that the moving member is moved to its first position and during selective communication of its automatic control chamber with the high-pressure fluid source the effect of the pressure of the fluid contained in said automatic control chamber is greater than said sum so that the moving member is moved to its second position and during selective communication of its intentional control chamber with the unpressurized fluid the effect of the pressure of the fluid contained in the automatic control chamber on the moving member is greater than that of the sum of the effects of the unpressurized fluid contained in the intentional control chamber and of the return spring member so that the moving member is moved to its second position.

A first advantage of the invention is the result of replacing the slide valve of one shuttle valve with those of two valves which are shorter in the axial direction. In one preferred solution, both valves are at the periphery of the mechanism, in the wall of its casing, which avoids congestion at the center of the motor and reduces its overall radial size. Also, said two valves can be identical and of a standard design, which reduces the cost of the mechanism.

The invention will be better understood and its secondary features and their advantages will emerge from the description of one embodiment of the invention given below by way of example.

BRIEF DESCRIPTION OF THE DRAWINGS

It is to be understood that the description and drawings are given by way of non-limiting example only.

Reference will be made to the appended drawings, in which:

FIGS. 5 to 9 show a reversible hydraulic motor in accordance with the invention which has four operating modes shown schematically in FIGS. 1 to 4.

MORE DETAILED DESCRIPTION

Figure 1:
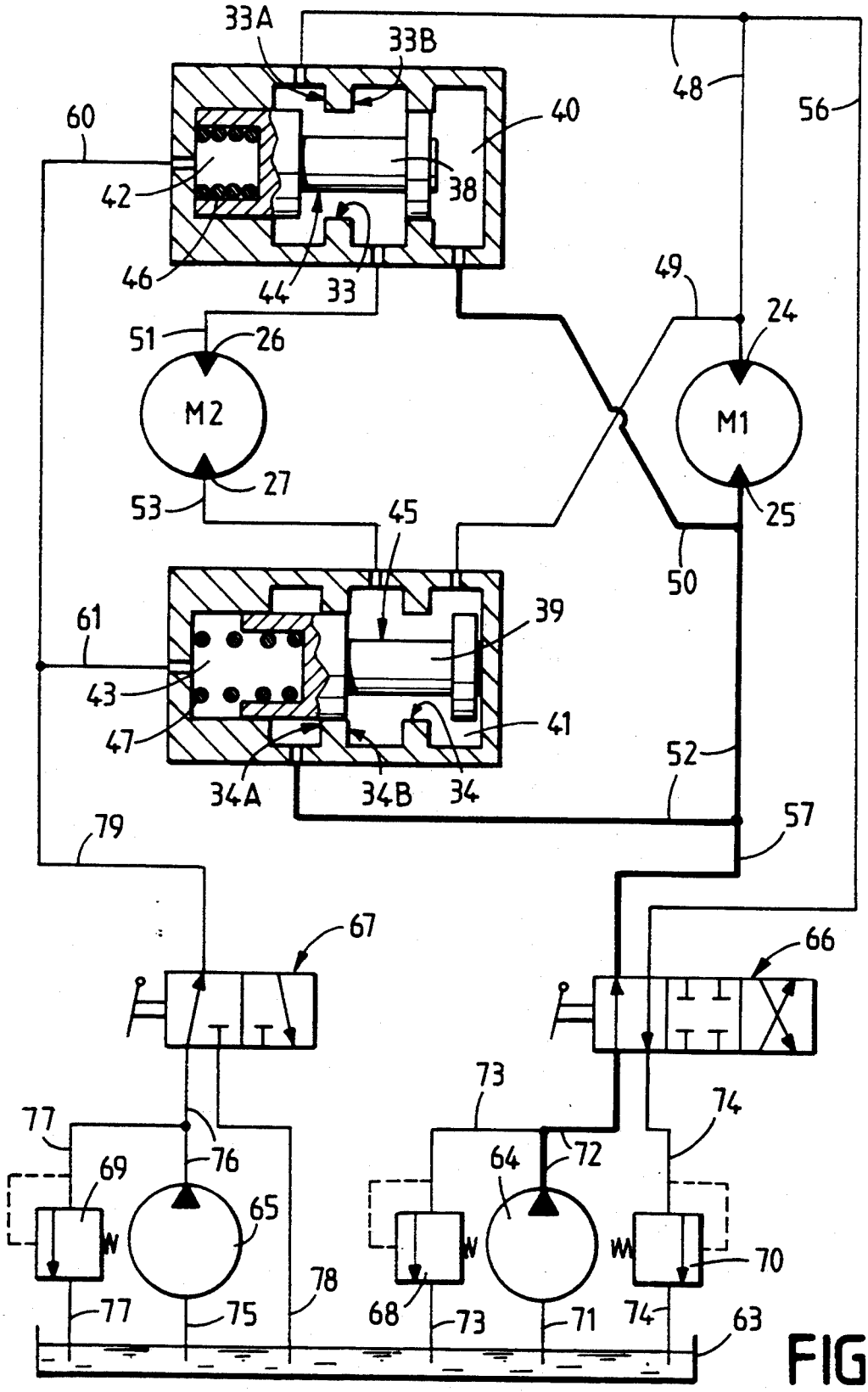
FIGS. 1 to 4 are schematic representations of a hydraulic circuit equivalent to a hydraulic motor in accordance with the invention, in four respective and different operating configurations.

This hydraulic motor includes:

a casing in three parts 1A, 1B, 1C fastened together by screws 2;

an output shaft 3 fitted with a fixing flange 4 and rotatable relative to part 1C of the casing about a geometrical axis 6 in two roller bearings 5;

a removable back 7 which closes off the casing and is fixed to part 1A of the casing by screws 8;

an undulating cam 9 formed by the inside axial periphery of part 1B of the casing;

a cylinder block 10 contained in the closed enclosure 18 delimited by the casing, in which are a plurality of cylinders 11 disposed radially relative to the axis 6 and which includes a central bore with splines 12 coaxial with the axis 6 and a plane communication side 13 perpendicular to the axis 6, the splines 12 of the cylinder block being interleaved with splines 14 on the inner end of the output shaft 3;

a plurality of pistons 15 each inserted in and adapted to slide relative to one of said cylinders 11, in which it defines a working chamber 16 for a fluid communicating at all times with the communication side 13 via a cylinder conduit 17 in the cylinder block 10; the various cylinder conduits 17 open onto the communication side 13 via orifices 17A centered on a common circle concentric with the axis 6;

a plurality of cylindrical rollers 19 each rotatably mounted on the end of a piston opposite the chamber 16, with axes 20 parallel to the axis 6 and adapted to form bearing members of the pistons 15 on the cam 9;

an internal fluid distributor 21 contained in the enclosure 18 delimited by the casing 1A-1B-1C, having an axial side 22 conformed complementarily with a staggered recess 23 coaxial with the axis 6 in part 1A of the casing, four grooves 24, 25, 26, 27 being formed between part 1A of the casing and the internal fluid distributor and isolated from each other, said internal fluid distributor 21 also having a plane distribution side 28 perpendicular to the axis 6 adapted to be held in contact with the communication side 13;

a device with pegs and complementary notches 62 immobilizes the internal fluid distributor 21 against rotation relative to part 1A of the casing about the axis 6;

four pluralities of distribution conduits 29, 30, 31, 32 which connect the respective grooves 24, 25, 26, 27 to the distribution side 28, opening onto the latter via orifices centered on the same circle concentric with the axis 6 as the orifices 17A of the cylinder conduits 17;

two blind bores 33, 34 the same length and diameter in part 1A of the casing, opening onto one transverse end face 35 of part 1A of the casing, with respective axes 36, 37 parallel to the axis 6, each having a first groove 33A, 34A and a second groove 33B, 34B, respectively, opening thereonto;

two identical slide valves 38, 39 adapted to slide in the bores 33, 34 to which they are sealed and in which they define at one end an automatic control chamber 40, 41 and at the other end an intentional control chamber 42, 43 and each having an intermediate groove 44, 45, a spring 46, 47 disposed between the back 7 of the casing, which the outlets from the intentional control chambers 42, 43 face, and each slide valve 38, 39, tending to minimize the volume of the respective automatic control chamber 40, 41;

internal conduits in part 1A of the casing permanently connecting the various grooves and chambers, as follows:

conduit 48 connects grooves 33A and 24;

conduit 49 connects groove 24 to automatic control chamber 41;

conduit 50 connects groove 25 to automatic control chamber 40;

conduit 51 connects grooves 26 and 33B;

conduit 52 connects grooves 25 and 34A;

conduit 53 connects grooves 34B and 27;

connectors 54, 55 of external conduits 56, 57 establish communication of these external conduits with the respective first grooves 33A, 34A and are formed in part 1A of the casing;

connectors 58, 59 of external conduits 60, 61 establish communication of these external conduits with the respective intentional control chambers 42, 43 and are formed in the back 7 closing off the casing.

The motor shown has a cam 9 with six undulations to which there correspond 12 distribution conduits. These undulations constitute two groups of undulations to which there correspond the following two groups of distribution conduits:

the distribution conduits 29 and 30 for respectively supplying pressurized fluid and providing an outlet for fluid from the fluid working chambers 16 delimited by the pistons 15 which at this time bear on the undulations of the cam 9 corresponding to said distribution conduits 29, 30; and the distribution conduits 31, 32 for respectively supplying pressurized fluid and providing an outlet for fluid from the fluid working chambers 16 delimited by the pistons 15 which at this time bear on the undulations of the cam 9 corresponding to said distribution conduits 31, 32.

In this motor the grooves 33A and 34A constitute the main fluid inlet and outlet chambers. The grooves 24, 25, 26 and 27 constitute the secondary fluid inlet and outlet chambers.

The slide valves 38, 39 can each assume two separate positions:

the first position of the slide valve 38 corresponds to predominance of the effects of the pressure of the fluid contained in the intentional control chamber 42 and the spring 46 over the effect of the pressure of the fluid contained in the automatic control chamber 40 and to communication between the second groove 33B and the automatic control chamber 40, the first groove 33A being isolated from the second groove 33B and the automatic control chamber 40;

the second position of the slide valve 38 corresponds to predominance of the effect of the pressure of the fluid contained in the automatic control chamber 40 over the effects of the pressure of the fluid contained in the intentional control chamber 42 and the spring 46 and to communication between the first groove 33A and the second groove 33B, the automatic control chamber 40 being isolated from both these grooves;

the first position of the slide valve 39 corresponds to predominance of the effects of the pressure of the fluid contained in the intentional control chamber 43 and the spring 47 over the effect of the pressure of the fluid contained in the automatic control chamber 41 and to communication between the second groove 34B and the automatic control chamber 41, the first groove 34A being isolated from the second groove 34B and the automatic control chamber 41;

the second position of the slide valve 39 corresponds to predominance of the effect of the pressure of the fluid contained in the automatic control chamber 41 over the effects of the pressure of the fluid contained in the intentional control chamber 43 and the spring 47 and to communication between the first groove 34A and the second groove 34B, the automatic control chamber 41 being isolated from both these grooves.

The hydraulic motor shown is equivalent to two motors in the same casing, one motor M1 corresponding to the three undulations of the cam 9 associated with the distribution conduits 29 and 30 and the other motor M2 corresponding to the three undulations of the cam 9 associated with the distribution conduits 31 and 32.

The arrangements just described are shown schematically in FIGS. 1 to 4 integrated into a circuit including:

an unpressurized fluid reservoir 63;

a main pump 64;

a control pump 65;

a three-position fluid distributor 66;

a two-position fluid distributor 67;

two pressure relief valves 68, 69 providing protection against overpressures, respectively set to operate at pressures in the order of 450 bars and 50 bars; and a fluid check valve 70 set to operate at a pressure of approximately 20 bars;

and the following connecting conduits:

the inlet conduit 71 of the main pump 64 connecting the latter to the reservoir 63;

the outlet conduit 72 of the main pump 64 connecting the latter to the fluid distributor 66;

a pressure relief conduit 73 connected to the outlet conduit 72, which it connects to the reservoir 63 and on which is the pressure relief valve 68;

a conduit 74 which connects the fluid distributor to the reservoir 63 and on which is the check valve the conduits 56, 57 connected to the fluid distributor 66;

the inlet conduit 75 of the control pump 65 connecting the latter to the reservoir 63;

the outlet conduit 76 of the control pump 65 connecting the latter to the fluid distributor 67;

a pressure relief conduit 77 connected to the outlet conduit 76 which it connects to the reservoir 63 and on which is the pressure relief valve 69;

a conduit 78 connecting the fluid distributor 67 to the reservoir 63; and a conduit 79 connecting the fluid distributor 67 to the conduits 60 and 61.

The three positions of the fluid distributor 66 correspond to:

in the case of the first position, communication between conduits 72 and 57 and between conduits 56 and 74;

in the case of the second position, closing off of conduits 56, 57, 72 and 74; and in the case of the third position, communication between conduits 72 and 56 and between conduits 57 and 74.

The two positions of the fluid distributor 67 correspond to:

in the case of the first position, communication between conduits 79 and 78 and closing off of conduit 76; and in the case of the second position, communication between conduits 76 and 79 and closing off of conduit 78.

Figure 2:
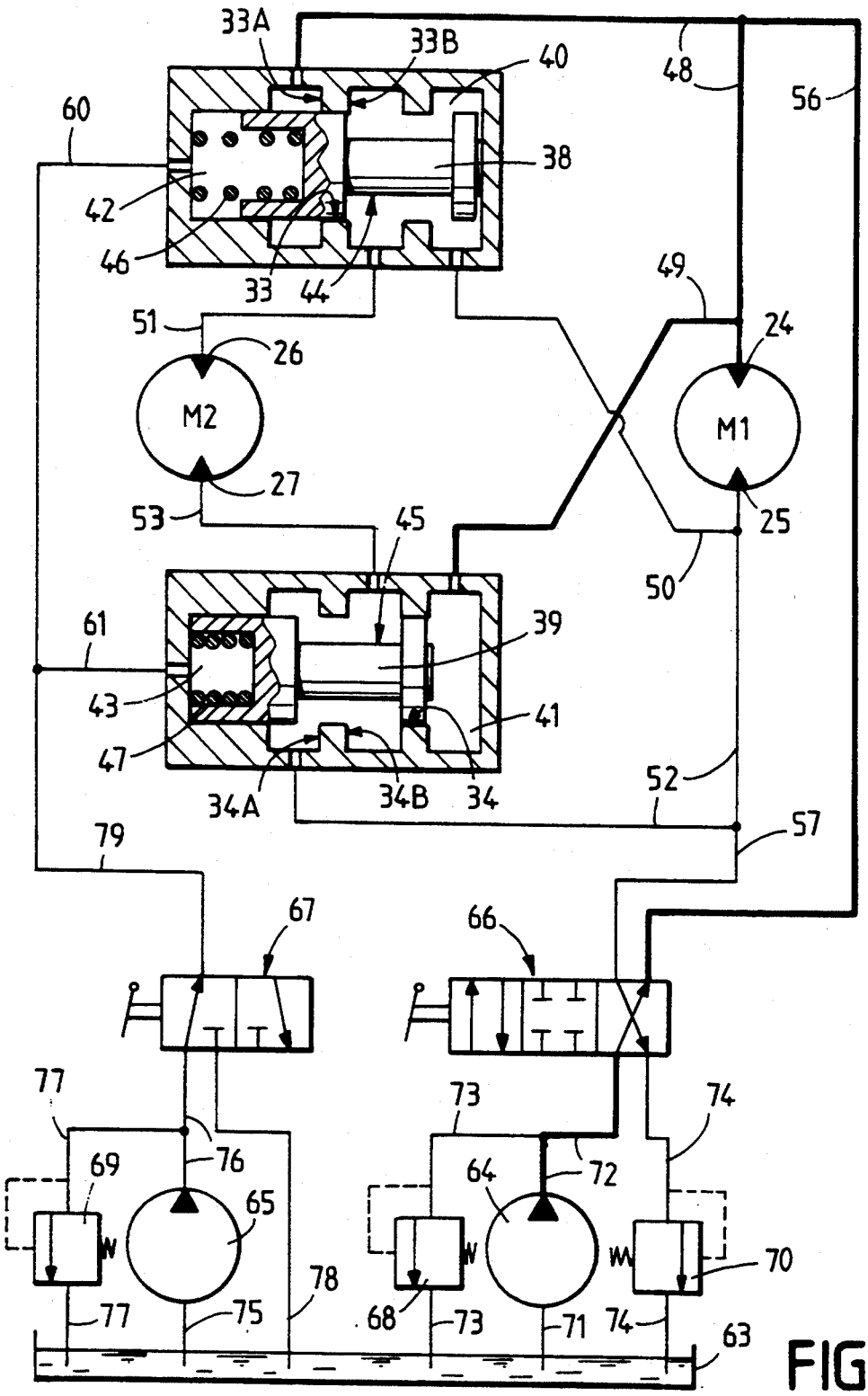
Figure 3:
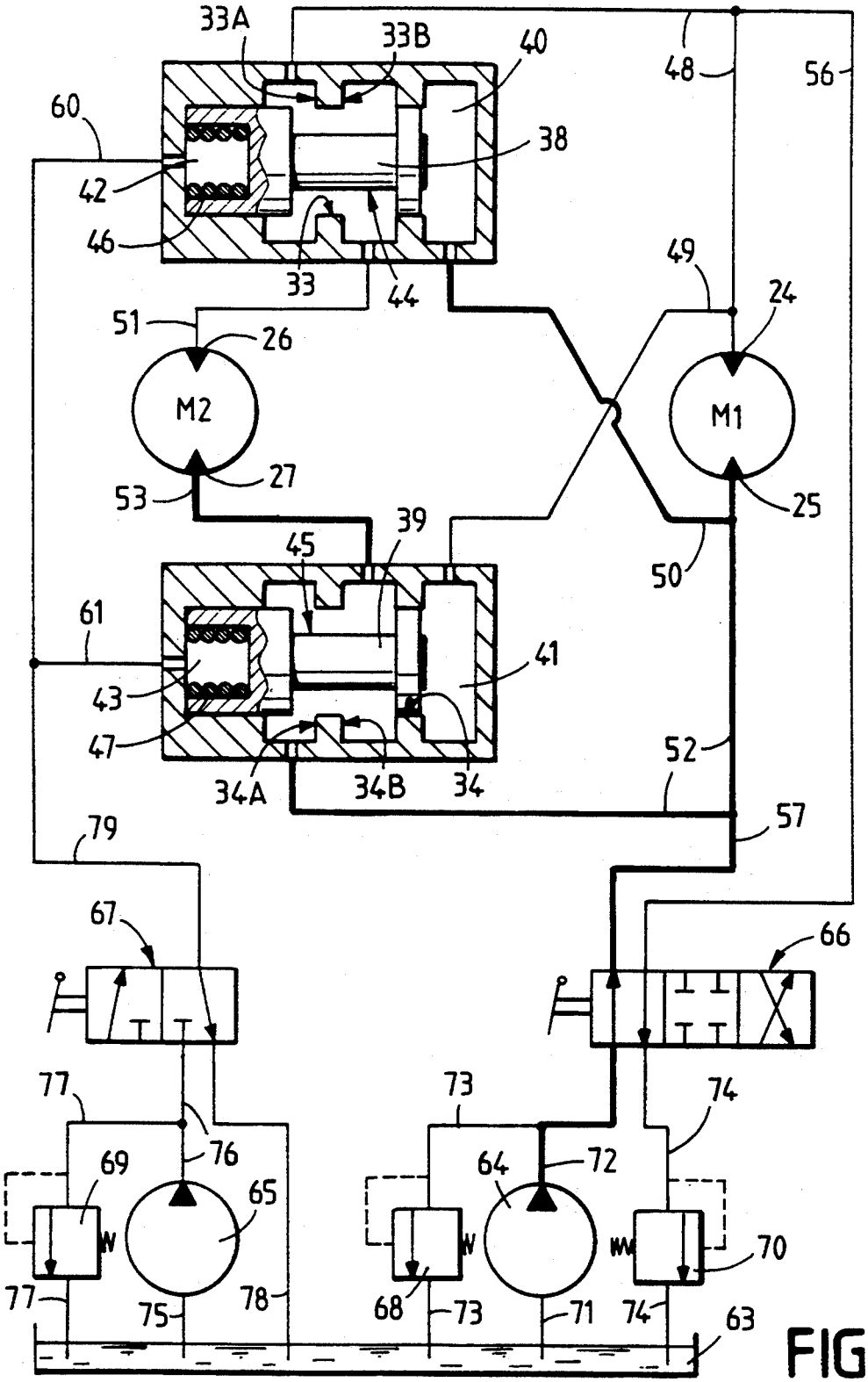
Figure 4:
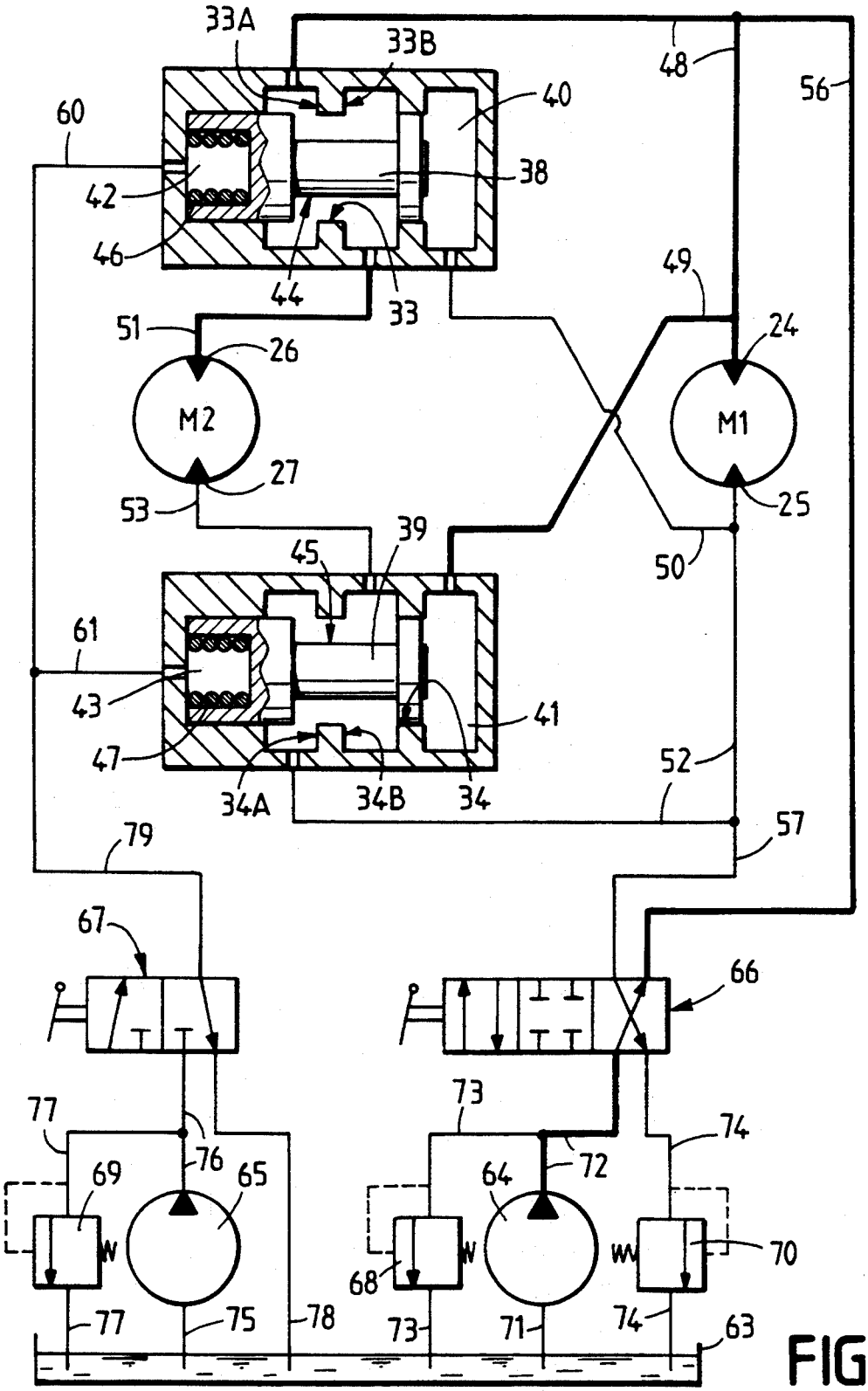
Figure 5:
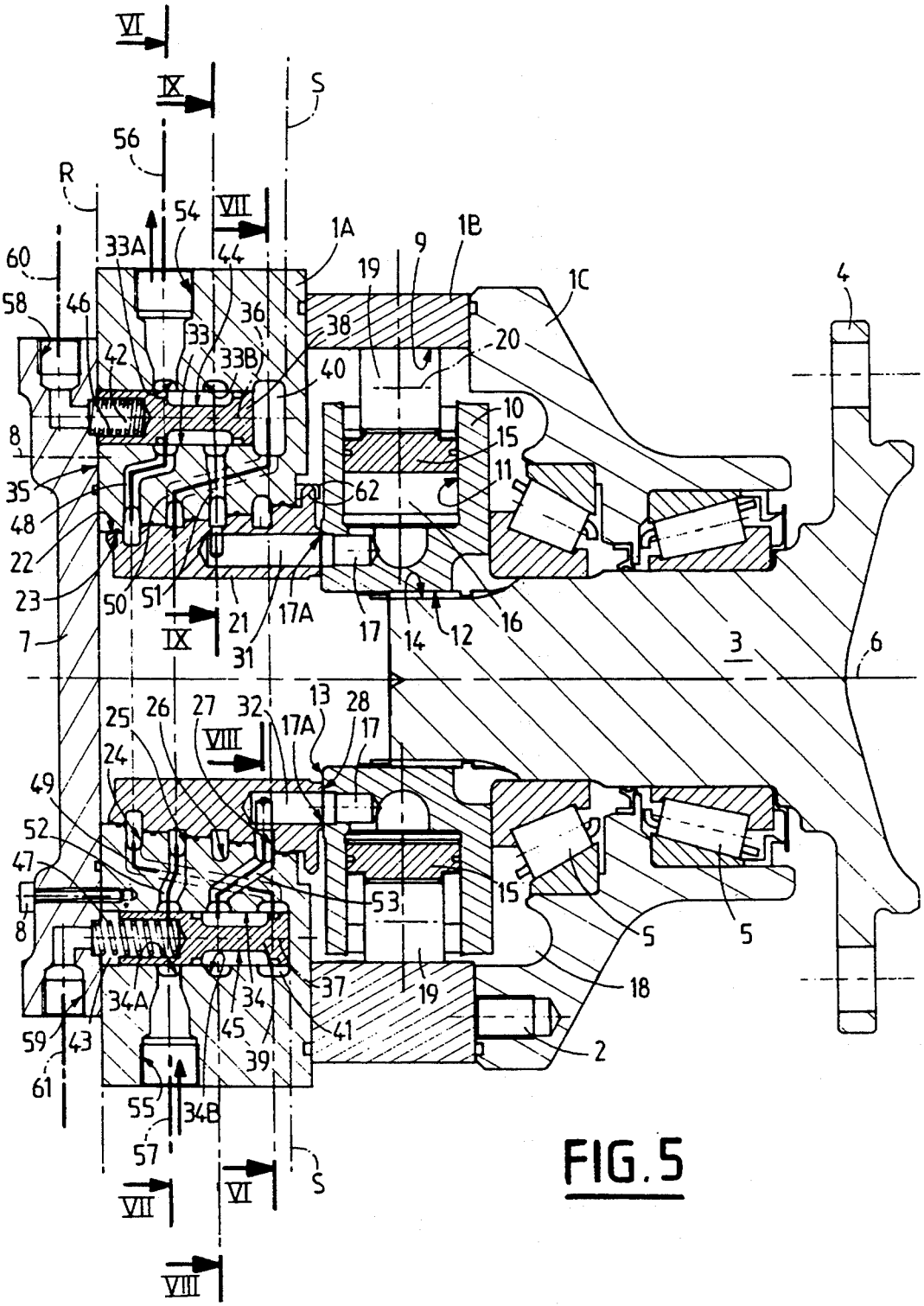
FIG. 5 is an axial section of the aforementioned hydraulic motor on V—V in FIG. 7 and in the configuration corresponding to FIG. 1.
Figure 6:
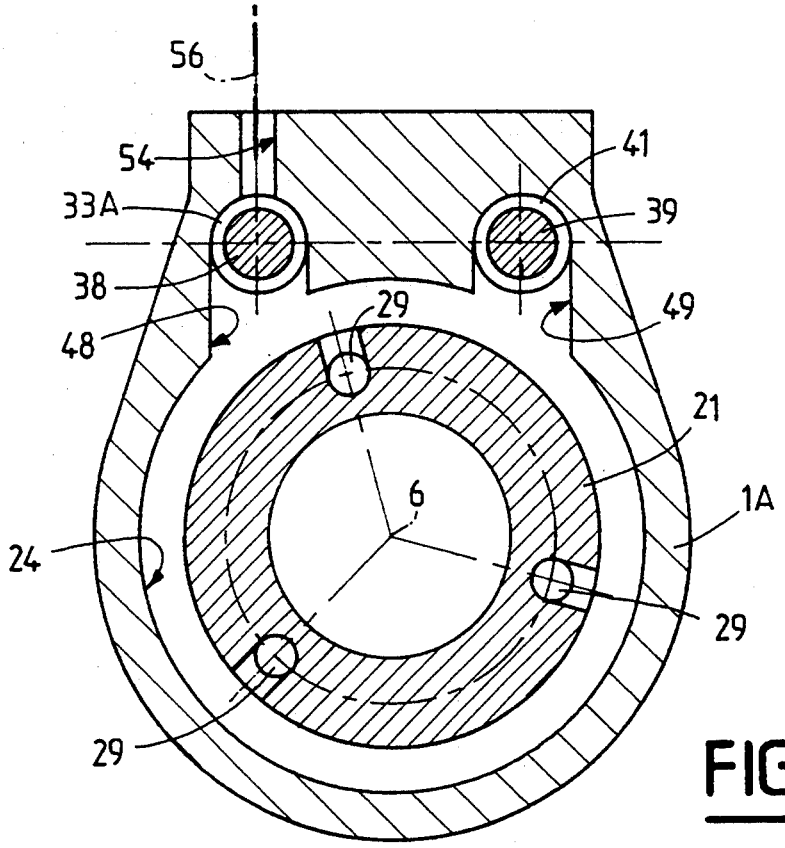
FIGS. 6, 7, 8 and 9 are sections on VI—VI, VII—VII, VIII—VIII and IX—IX, respectively, in FIG. 5.
Figure 7:
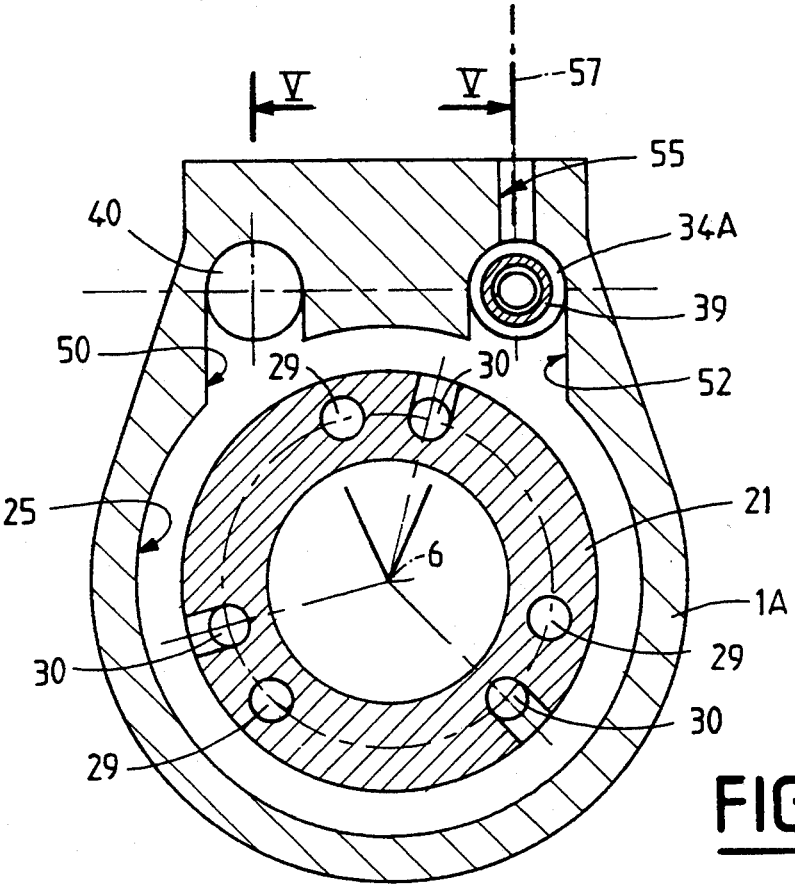
Figure 8:
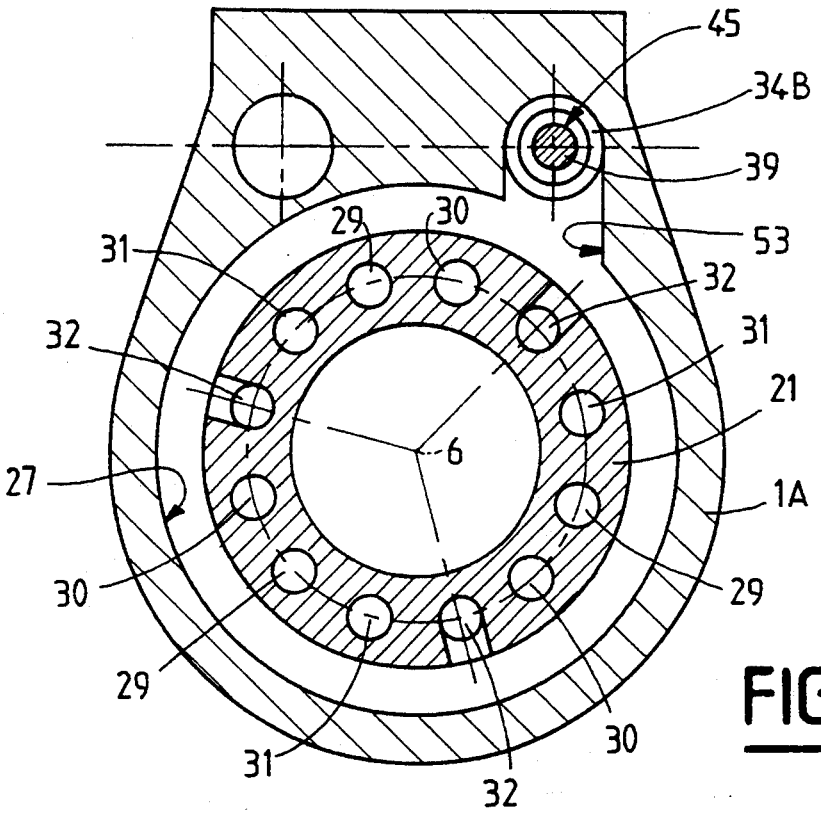
Figure 9:
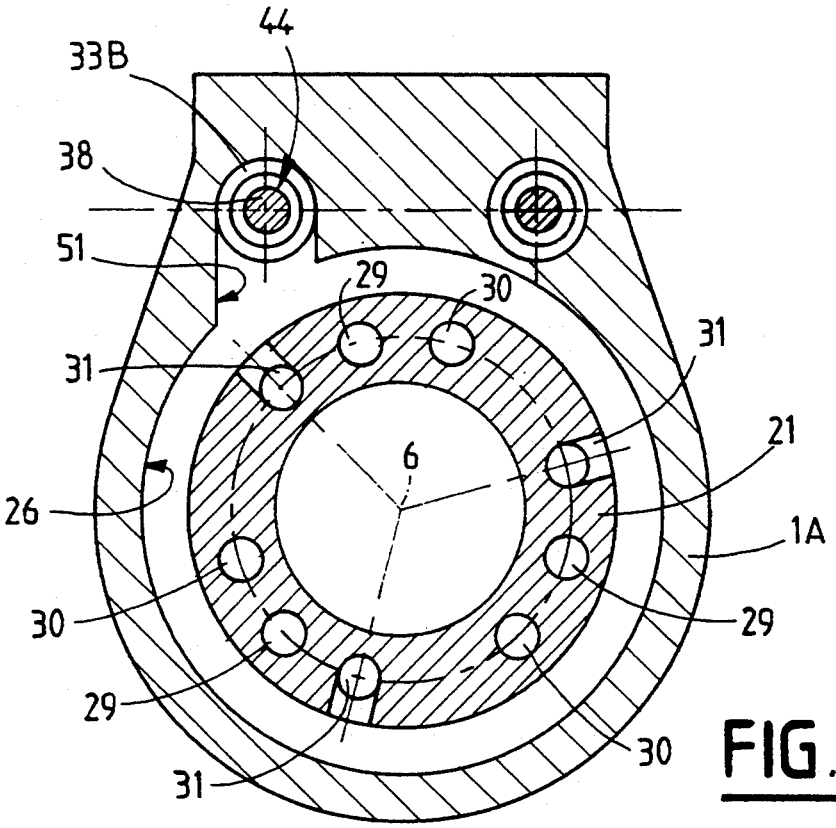

With reference to FIGS. 1 to 4, note the concomitance of the following positions:

in the case of FIG. 1, the fluid distributors 66 and 67 are in their respective first and second positions; the effect of the high-pressure (450 bars) fluid contained in the automatic control chamber 40 predominates over the sum of the effects of the spring 46 and the pressure of the control fluid discharged by the control pump 65 and contained in the intentional control chamber 42 and moves the slide valve 38 to its second position; on the other hand, the sum of the effects of the spring 47 and the pressure of the control fluid contained in the intentional control chamber 43 predominates over the effect of the pressure of the fluid retained by the check valve 70 and contained in the automatic control chamber 41 and moves the slide valve 39 to its first position;

in the case of FIG. 2, the fluid distributors 66 and 67 are in their respective third and second positions; the effect of the high-pressure (450 bars) fluid contained in the automatic control chamber 41 predominates over the sum of the effects of the spring 47 and the pressure of the control fluid discharged by the control pump 65 and contained in the intentional control chamber 43 and moves the slide valve 39 to its second position; on the other hand, the sum of the effects of the spring 46 and the pressure of the control fluid contained in the intentional control chamber 42 predominates over the effect of the pressure of the fluid retained by the check valve 70 and contained in the automatic control chamber 40 and moves the slide valve 38 to its first position;

in the case of FIG. 3, the fluid distributors 66 and 67 are in their respective first positions; the effect of the pressure of the fluid contained in the automatic control chamber 40 predominates over the effect of the spring 46 and moves the slide valve 38 to its second position; the effect of the pressure of the fluid retained by the check valve 70 and contained in the automatic control chamber 41 also predominates over the effect of the spring 47 and moves the slide valve 39 to its second position; finally in the case of FIG. 4, the fluid distributors 66 and 67 are in their respective third and first positions; the effect of the pressure of the fluid contained in the automatic control chamber 41 predominates over the effect of the spring 47 and moves the slide valve 39 to its second position; the effect of the pressure of the fluid retained by the check valve 70 and contained in the automatic control chamber 40 also predominates over the effect of the spring 46 and moves the slide valve 38 to its second position.

Finally, note that regardless of the chosen position of the fluid distributor 66 (first or third position):

choosing the first position of fluid distributor 67 feeds pressurized fluid in parallel to motors M1 and M2 and drives them in a first rotation direction (FIG. 3) or in the opposite direction (FIG. 4) and corresponds to a "large" capacity equal to the sum (C1+C2) of the capacity C1 of motor M1 and the capacity C2 of motor M2;

choosing the second position of fluid distributor 67 feeds pressurized fluid to motor M1 only and drives it in said first rotation direction (FIG. 1) or in the opposite rotation direction (FIG. 2), the conduits 51 and 53 connected to the motor M2 being connected together in each of these two configurations, either via grooves 33B, 44 and 33A, conduits 48, 49, automatic control chamber 41 and grooves 45 and 33B (FIG. 1) or via grooves 34B, 45 and 34A, conduits 52, 50, automatic control chamber 40 and grooves 44 and 33B (FIG. 2); this second position of the fluid distributor 67 therefore also corresponds to a "small" active capacity equal to the capacity C1 of motor M1 only, motor M2 being "short-circuited".

The slide valve 38 and the associated bore 33 in which it slides constitute a first valve extending between two transverse planes R and S perpendicular to the axis 6; note that the slide valve 39 and the associated bore 34 constitute a second valve identical to the first valve and extending between the same transverse planes R and S.

Thus:

the arrangement shown can select the active capacity (C1 or C1+C2) of a hydraulic motor having two different capacities;

implementing the selector device by adopting two identical valves (33–38 and 34–39) favors a low unit cost, each valve being of simple design (only one groove 44, 45 per slide valve 38, 39), being therefore of compact overall size in the axial direction and obviously being more compact than some prior art single valves providing selective communication between and selective isolation of four successive grooves in the valve body by means of a slide valve with two grooves, such as the valve shown in FR-A-2 481 755, for example.

Placing the two valves between the same two transverse planes R, S contributes to the implementation of a hydraulic motor which is compact in the axial direction and therefore also light in weight.

Forming the body of each valve directly in the wall of part 1A of the casing also contributes to a simple design which is compact in the radial direction and consequently light in weight.

Note that in the configurations of FIGS. 1 and 2, which correspond to the small active capacity C1, the "short-circuited" motor M2 is fed with low-pressure fluid whose pressure is equal to that to which the check valve 70 is set (20 bars) and which irrigates and cools the corresponding cylinders and pistons and prevents the premature wear which would result from irrigation by a high-pressure fluid; also the hydraulic motor as described is reversible, the high-pressure fluid being contained either in the conduits 57 and 52 (FIGS. 1 and 3) or in the conduits 56 and 48 (FIGS. 2 and 4).

The invention is not limited to the embodiment described, but on the contrary encompasses all variants thereof which do not depart from the spirit or scope of the invention.

We claim:

1. A pressurized fluid mechanism having at least two operating capacities, comprising:

a stator;

a rotor rotatable relative to the stator about a rotation axis;

a main fluid inlet and outlet chambers, one adapted to communicate selectively with a source of pressurized fluid and the other adapted to communicate selectively with a low-pressure return;

an undulating cam indlucing a plurality of undulations divided into two groups of first undulations and second undulations, respectively;

a plurality of cylinders inside each of which slides at least one piston defining a working chamber inside said cylinder;

an internal distributor for distributing fluid to said working chambers including first secondary inlet and outlet chambers for distributing fluid to the working chambers in the cylinders facing the undulations of the first group of undulations and second secondary inlet and outlet chambers for distrubting fluid to the working chambers in the cylinders facing the undulations of the second group of undulations; and a capacity selector device which in a "large capacity" first configuration connects in parallel firstly in first and second secondary inlet chambers and secondly the first and second secondary outlet chambers and in a "small capacity" second configuration isolates the second secondary inlet and outlet chambers from whichever of the main inlet and outlet chambers contains the fluid at the higher pressure and establishes communication of said second secondary inlet and outlet chambers with each other and with whichever of the main inlet and outlet chambers contains the fluid at the lower pressure;

wherein:

A) the capacity selector device comprises a first valve and a second valve each of which has a valve body, a member mobile in said body between first and second positions, the moving members of the two valves being separate and independent of each other, a first groove in said body, a second groove in said body, an automatic control chamber and an intentional control chamber, said intentional control chamber being adapted to contain selectively a control fluid from a control fluid source and an unpressurized fluid and the first groove of one of the first and second valves constituting said main inlet chamber, the first groove of the other one of the first and second valves constituting said main outlet chamber;

B) the following connections are made:

the connection of the main inlet chamber to the first secondary inlet chamber;

the connection of the main outlet chamber to the first secondary outlet chamber;

the connection of the first secondary inlet chamber to the automatic control chamber of the first valve;

the connection of the first secondary outlet chamber to the automatic control chamber of the second valve;

the connection of the second groove of the first valve to the second secondary outlet chamber; and the connection of the second groove of the second valve to the second secondary inlet chamber;

C) the first valve in its first position establishes communication between its second groove and its automatic control chamber and isolates its first groove from its second groove and from said automatic control chamber and in its second position establishes communication of its first and second grooves with each other and isolates its automatic control chamber from said first and second grooves;

D) the second valve in its first position establishes communication between its second groove and its automatic control chamber and isolates its first groove from its second groove and from said automatic control chamber and in its second position establishes communication of its first and second grooves with each other and isolates its automatic control chamber from said first and second grooves;

E) so that the following configurations can be selected:

E1—communication of the intentional control chambers of the first and second valves with a reservoir of unpressurized fluid causing the moving members of the first and second valves to be moved to their respective second position and selecting the "large capacity" configuration;

E2—communication of the first secondary inlet chamber with a pressurized fluid source, of the first secondary outlet chamber with a low-pressure return and of the intentional control chambers of the first and second valves with a control fluid source causing the moving member of the first valve to be moved to its second position and the moving member of the second valve to be moved to its first position and thereby selecting the "small capacity" configuration corresponding to rotation of the rotor in a first direction of rotation;

E3—communication of the first secondary inlet chamber with a low-pressure return, of the first secondary outlet chamber with a high-pressure fluid source and of the intentional control chambers of the first and second valves with a control fluid source causing the moving member of the first valve to be moved to its first position and the moving member of the second valve to be moved to its second position and thereby selecting the "small capacity" configuration corresponding to rotation of the rotor in the direction of rotation opposite to said first direction of rotation.

2. A mechanism according to claim 1 wherein the moving member of each of the first and second valves comprises a slide valve having an axis constituting a slide axis of said slide valve, the slide axes of said slide valves of the two valves being separate and both parallel to the rotation axis, the body of the first valve extending between two transverse planes perpendicular to the rotation axis and the body of the second valve extending substantially between the same transverse planes so that the overall longitudinal dimension of the set of two valves is substantially equal to that of each valve.

3. A mechanism according to claim 2 including a casing containing the internal fluid distributor and delimited by a wall in which are formed the bodies of said first and second valves.

4. A mechanism according to claim 3 wherein each of the first and second valves has a return spring member urging its moving member towards its first position against the action of the pressure of the fluid contained in its automatic control chamber and during selective communication of its intentional control chamber with the control fluid when the automatic control chamber contains the low-pressure return fluid, the sum of the effects of the pressure of the control fluid and the return spring member on the moving member is greater than the effect of the pressure of the fluid contained in the automatic control chamber so that the moving member is moved to its first position and during selective communication of its automatic control chamber with the high-pressure fluid source the effect of the pressure of the fluid contained in said automatic control chamber is greater than said sum so that the moving member is moved to its second position and during selective communication of its intentional control chamber with the unpressurized fluid the effect of the pressure of the fluid contained in the automatic control chamber on the moving member is greater than that of the sum of the effects of the unpressurized fluid contained in the intentional control chamber and of the return spring member so that the moving member is moved to its second position.

5. A mechanism according to claim 2 wherein each of the first and second valves has a return spring member urging its moving member towards its first position against the action of the pressure of the fluid contained in its automatic control chamber and during selective communication of its intentional control chamber with the control fluid when the automatic control chamber contains the low-pressure return fluid, the sum of the effects of the pressure of the control fluid and the return spring member on the moving member is greater than the effect of the pressure of the fluid contained in the automatic control chamber so that the moving member is moved to its first position and during selective communication of its automatic control chamber with the high-pressure fluid source the effect of the pressure of the fluid contained in said automatic control chamber is greater than said sum so that the moving member is moved to its second position and during selective communication of its intentional control chamber with the unpressurized fluid the effect of the pressure of the fluid contained in the automatic control chamber on the moving member is greater than that of the sum of the effects of the unpressurized fluid contained in the intentional control chamber and of the return spring member so that the moving member is moved to its second position.

6. A mechanism according to claim 1 including a casing containing the internal fluid distributor and delimited by a wall in which are formed the bodies of said first and second valves.

7. A mechanism according to claim 6 wherein each of the first and second valves has a return spring member urging its moving member towards its first position against the action of the pressure of the fluid contained in its automatic control chamber and during selective communication of its intentional control chamber with the control fluid when the automatic control chamber contains the low-pressure return fluid, the sum of the effects of the pressure of the control fluid and the return spring member on the moving member is greater than the effect of the pressure of the fluid contained in the automatic control chamber so that the moving member is moved to its first position and during selective communication of its automatic control chamber with the high-pressure fluid source the effect of the pressure of the fluid contained in said automatic control chamber is greater than said sum so that the moving member is moved to its second position and during selective communication of its intentional control chamber with the unpressurized fluid the effect of the pressure of the fluid contained in the automatic control chamber on the moving member is greater than that of the sum of the effects of the unpressurized fluid contained in the intentional control chamber and of the return spring member so that the moving member is moved to its second position.

8. A mechanism according to claim 1 wherein the moving members of the first and second valves are identical.

9. A mechanism according to claim 8 wherein each of the first and second valves has a return spring member urging its moving member towards its first position against the action of the pressure of the fluid contained in its automatic control chamber and during selective communication of its intentional control chamber with the control fluid when the automatic control chamber contains the low-pressure return fluid, the sum of the effects of the pressure of the control fluid and the return spring member on the moving member is greater than the effect of the pressure of the fluid contained in the automatic control chamber so that the moving member is moved to its first position and during selective communication of its automatic control chamber with the high-pressure fluid source the effect of the pressure of the fluid contained in said automatic control chamber is greater than said sum so that the moving member is moved to its second position and during selective communication of its intentional control chamber with the unpressurized fluid the effect of the pressure of the fluid contained in the automatic control chamber on the moving member is greater than that of the sum of the effects of the unpressurized fluid contained in the intentional control chamber and of the return spring member so that the moving member is moved to its second position.

10. A mechanism according to claim 1 wherein each of the first and second valves has a return spring member urging its moving member towards its first position against the action of the pressure of the fluid contained in its automatic control chamber and during selective communication of its intentional control chamber with the control fluid when the automatic control chamber contains the low-pressure return fluid, the sum of the effects of the pressure of the control fluid and the return spring member on the moving member is greater than the effect of the pressure of the fluid contained in the automatic control chamber so that the moving member is moved to its first position and during selective communication of its automatic control chamber with the high-pressure fluid source the effect of the pressure of the fluid contained in said automatic control chamber is greater than said sum so that the moving member is moved to its second position and during selective communication of its intentional control chamber with the unpressurized fluid the effect of the pressure of the fluid contained in the automatic control chamber on the moving member is greater than that of the sum of the effects of the unpressurized fluid contained in the intentional control chamber and of the return spring member so that the moving member is moved to its second position.

* * * * *